US007121269B2

(12) United States Patent
North

(10) Patent No.: US 7,121,269 B2
(45) Date of Patent: Oct. 17, 2006

(54) HOT-START SOLENOID VALVE

(75) Inventor: Michael North, 3841 Mari La. SE., Olympia, WA (US) 98513

(73) Assignee: Michael North, Olympia, WA (US)

( * ) Notice: Subject to any disclaimer, the term of this patent is extended or adjusted under 35 U.S.C. 154(b) by 66 days.

(21) Appl. No.: 10/825,791

(22) Filed: Apr. 16, 2004

(65) Prior Publication Data

US 2004/0206326 A1 Oct. 21, 2004

Related U.S. Application Data

(60) Provisional application No. 60/463,619, filed on Apr. 16, 2003.

(51) Int. Cl.
*F02B 23/00* (2006.01)

(52) U.S. Cl. ..... 123/585

(58) Field of Classification Search ..... 123/585, 123/588

See application file for complete search history.

(56) References Cited

U.S. PATENT DOCUMENTS

| | | | | |
|---|---|---|---|---|
| 3,960,130 | A | 6/1976 | Peterson, Jr. | |
| 3,977,380 | A | 8/1976 | Atsumi et al. | |
| 4,092,292 | A | 5/1978 | Braus et al. | |
| 4,300,501 | A * | 11/1981 | Suzuki | 477/111 |
| 4,465,050 | A * | 8/1984 | Igashira et al. | 123/472 |
| 4,488,524 | A * | 12/1984 | Sugiura et al. | 123/339.24 |
| 4,700,674 | A * | 10/1987 | Iwata | 123/327 |
| 4,760,824 | A * | 8/1988 | Sakurai | 123/339.15 |
| 4,886,035 | A | 12/1989 | Tomobe et al. | |
| 5,381,768 | A * | 1/1995 | Togai et al. | 123/587 |
| 5,487,372 | A * | 1/1996 | Iida et al. | 123/585 |
| 5,907,228 | A | 5/1999 | Thomas et al. | |
| 5,929,612 | A | 7/1999 | Eisenhaure et al. | |
| 5,986,428 | A | 11/1999 | Kono et al. | |
| 6,166,514 | A | 12/2000 | Ando et al. | |
| 6,208,112 | B1 | 3/2001 | Jensen et al. | |
| 6,352,068 | B1 * | 3/2002 | Jacobsen | 123/585 |
| 6,429,612 | B1 | 8/2002 | Kume et al. | |
| 2002/0189565 | A1 | 12/2002 | Okuma et al. | |

* cited by examiner

*Primary Examiner*—Henry C. Yuen
*Assistant Examiner*—Jason Benton
(74) *Attorney, Agent, or Firm*—Black Lowe & Graham PLLC

(57) ABSTRACT

The present invention discloses an air-entrainment mechanism for carbureted engine. The mechanism includes a plunger valve controlled by a solenoid. The solenoid is powered by a battery with a switch electrically coupled thereto. The plunger valve is interconnected to the carburetor to allow additional air entrainment. The solenoid is coupled to the valve for opening and closing the valve. The switch electrically couples the solenoid to the battery to activate the solenoid for movement of the valve. The switch disclosed herein includes a temperature sensor and an engine-running sensor. The switch is then closeable when the temperature sensor detects an engine temperature within a predetermined range as long as the engine is not already running.

37 Claims, 6 Drawing Sheets

HOT-START SOLENOID VALVE

This application claims priority from the Provisional Application entitled, "Hot Start Solenoid Valve" Ser. No. 60/463,619 filed on Apr. 16, 2003.

FIELD OF THE INVENTION

This invention relates generally to Engine Management and, more specifically, to carburetion controls.

BACKGROUND OF THE INVENTION

There are two current mechanisms used for hot-start valve manipulation: a cable and housing or cable operated systems used for manipulating a carburetor body-mounted valve or a manually manipulated carburetor body-mounted valve assembly 10*a* as is shown in FIG. 1*a*. The manually manipulated carburetor-mounted valve needle 18 requires the rider to take one hand off the handlebars and reach down to the valve location, grasp the valve handle 12 on the carburetor 30 to withdraw the valve needle 18 to admit atmospheric air 21. The act of manipulation is necessary whenever a restart is required or desired when the engine assembly is at operating temperatures or hot-start conditions. The act of removing the rider's hand from the handlebars and looking at the carburetor 30 in order to locate and manipulate the valve is time consuming and can be difficult during racing when rapid restarts are desired. These movements must be reversed to again replace the valve needle 18 under running conditions.

Cable-operated systems 10*b* allow for a handlebar located pull for remote activation and are an improvement over the carburetor-mounted valve as shown in FIG. 1*a*. This system uses a cable 13, connected to a lever that is mounted to a handlebar-mounted clamp, usually the backside of a brake clamp or incorporated into a clutch mount. Clamping along a frame of a motorcycle fixedly holds a housing 14 for the cable 13. The movement of the cable 13 within and relative to the housing 14 results in a precise movement used to open and close the valve needle 18. Free play adjustment is required to ensure proper valve needle 18 positioning in the carburetor body 30. This adjustment ensures that the valve needle 18 is not held out of its position in the carburetor body 30, effectively activating the hot-start system and introducing air 21 into the intake passage during normal operating conditions. It also ensures that when the lever is pushed, the cable 13 is sufficiently withdrawn as to provide adequate removal of the valve needle 18 from the carburetor body allowing the additional air into the intake passage that facilitates starting. Because of the necessity of regular adjustment to optimize the operation, cable operation is not adequate for a robust system.

What is needed in the art is a system that does not require adjustment. Additionally, there is an unmet need for a means of activation would allow for accurate sensing of the need for activation of a hot-start valve and would automatically activate or automatically allow activation of the valve. Additionally, an electrical system allows selective locking-out of the activation of the valve.

SUMMARY OF THE INVENTION

A solenoid-operated plunger valve controls airflow from the external environment to the air fuel mixture of the carburetor for an internal combustion engine. During normal operation, the valve plunger extends into the carburetor body, blocking the air passage used for introduction of additional air into the intake passage. During restarts at operating temperatures, the normally open switch is closed by the operator's thumb at the handlebar when hot engine conditions require additional air into the intake passage. Closing the switch allows electrical current stored in the battery to energize the solenoid, removing the plunger from the carburetor body and introducing additional air into the intake passage. In another preferred embodiment, there is a toggle switch that allows for "hands free" operation of the hot-start valve during race conditions. The toggle switches the hot-start system between manual (push button) activation and thermal switch activation with a time-out circuit. The time-out circuit allows for a predetermined amount of time to pass with the hot start activated while the engine is not running and above a set operating temp. This further reduces the need to visually locate a hot-start activation switch when quick restarts are necessitated by engine stalls during competition.

The preferred embodiment of the invention includes a hot-start mechanism for an internal combustion engine carburetor having an airflow passageway. The mechanism includes a valve, an electrically-operated valve-movement mechanism, and a valve switch. The valve is in fluid communication with the airflow passageway. The valve-movement mechanism is operatively connected to the valve to selectively move the valve. Activation of the valve-movement mechanism opens the valve to admit additional air into the airflow passageway. The valve switch is electrically coupled to the valve-movement mechanism for activation of the valve.

In one preferred embodiment, the invention includes a processor electrically coupled to the switch. A processor controls the valve and a power source is electrically coupled to the processor. The power source is preferably a battery. A solar collector is coupled to the battery to keep it charged in one embodiment.

A preferred embodiment of the valve-movement mechanism includes a solenoid. In such embodiment, the valve is more specifically a plunger valve.

One preferred aspect of the invention includes a temperature sensor interconnected with the processor. The temperature sensor provides a signal indicative of the engine temperature. The processor only activates the solenoid to open the valve when the engine temperatures are within a predetermined range.

Another preferred aspect of the invention includes an engine-running sensor interconnected with the processor. The engine-running sensor provides a signal to the processor indicative of whether the engine is running. The solenoid holds the valve closed upon an engine-running condition or a running condition at a certain RPM level. The engine-running sensor preferably includes a connection to an engine stator to magnetically sense the dynamic rotational state of the engine. Where both an engine-running sensor and a temperature sensor are employed, the processor opens the valve upon predetermined input from the sensors.

In one preferred embodiment, a timer switch for closing the valve after a predetermined time lapse is provided. An indicator light is also provided to signal to the user whether the valve is open. In one embodiment, an override switch is interconnected with the valve-movement mechanism to control the position of the valve regardless of input from the sensors.

In one embodiment where the engine includes a start switch, the valve switch is coupled to such start switch for opening of the valve if the engine temperatures are within a predetermined range and the start switch is activated.

The present invention also includes a method of starting a carbureted engine. The method includes the steps of determining the need for additional air entrainment into the carburetor, electrically opening an air-entrainment valve allowing additional air into the carburetor, cranking the engine until a running state is achieved, and closing the valve. In the preferred embodiments, a plunger valve is employed. The step of opening the valve is carried out with a solenoid coupled to the plunger valve. Engine temperature is sensed as part of the step of determining the need for additional air entrainment. Oxygen senors and other engine state sensors such as manifold air pressure are advantageously used to sense the engine state while not adding significantly to the cost. Sensing the running state of the engine also comprises part of such step. Preferably, a timeout switch is employed to close the valve after it is opened. Furthermore, a vehicle start switch is used in one embodiment to open the air-entrainment valve after the step of determining the need for additional air entrainment.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENTS

Figure 1A:
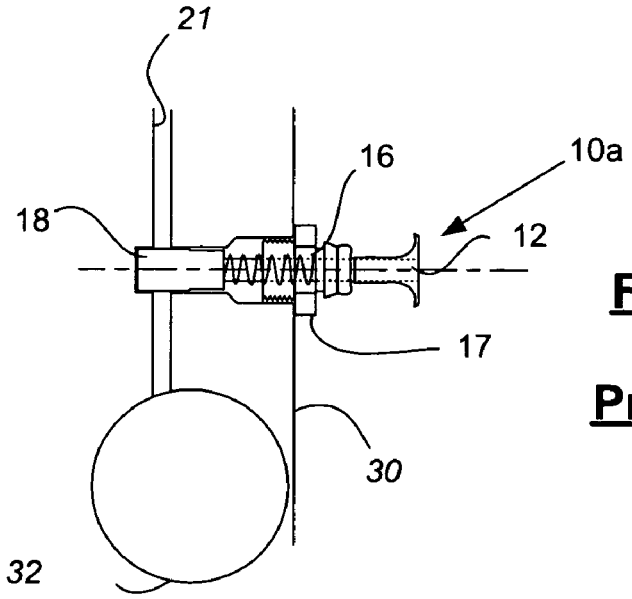
Figure 1a Prior Art
FIG. 1*a* is a side view of a prior-art manual plunger valve.

FIG. 1*a* is a diagram showing a prior-art carburetor-mounted valve. This type of valve mounts directly to a carburetor body, which is located in the engine area near the rider's knee when in the riding position. The operative elements of the prior-art valve include a handle 12 attached to a shaft 16 passing through a retaining nut 17 and affixed to a valve needle 18. A spring 11 urges the needle 18 into a seat on a carburetor body 30. An operator pulls the handle axially away from the retaining nut 14 thereby admitting air 21 into the carburetor bore 32 through the seat (not shown).

Figure 1B:
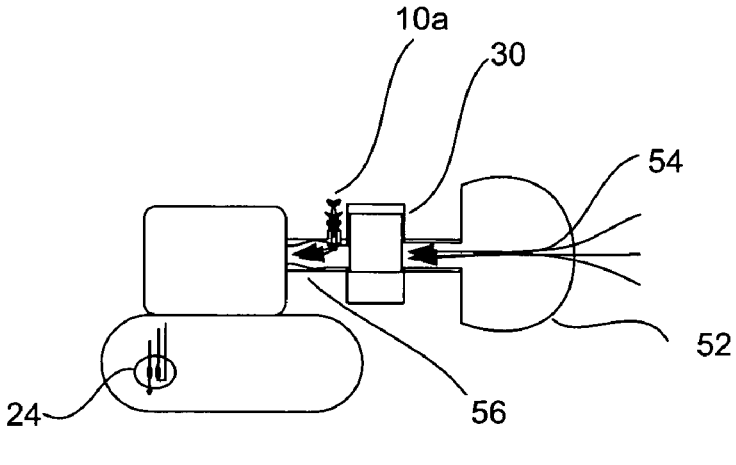
Figure 1b Prior Art
FIG. 1*b* is a system schematic of the prior-art manual plunger valve.

As illustrated in FIG. 1*b*, the plunger valve assembly 10 is incorporated onto a motorcycle internal combustion engine assembly 50 by installation into the carburetor body 56. Placement of the plunger valve assembly 10*a* requires the rider to remove a hand from handlebars to manipulate the plunger handle 12 during hot-start conditions. The plunger valve assembly 10 must be manipulated at its location on the carburetor throat 56, located near the rider's knee, while the rider is in the seated position, sitting on the motorcycle, in order to restart the engine 50.

Also shown is the air filter 52 in the airflow 54 into the engine 50. The carburetor body 30 are portrayed as is a stator 24 on an engine shaft.

Figure 2A:
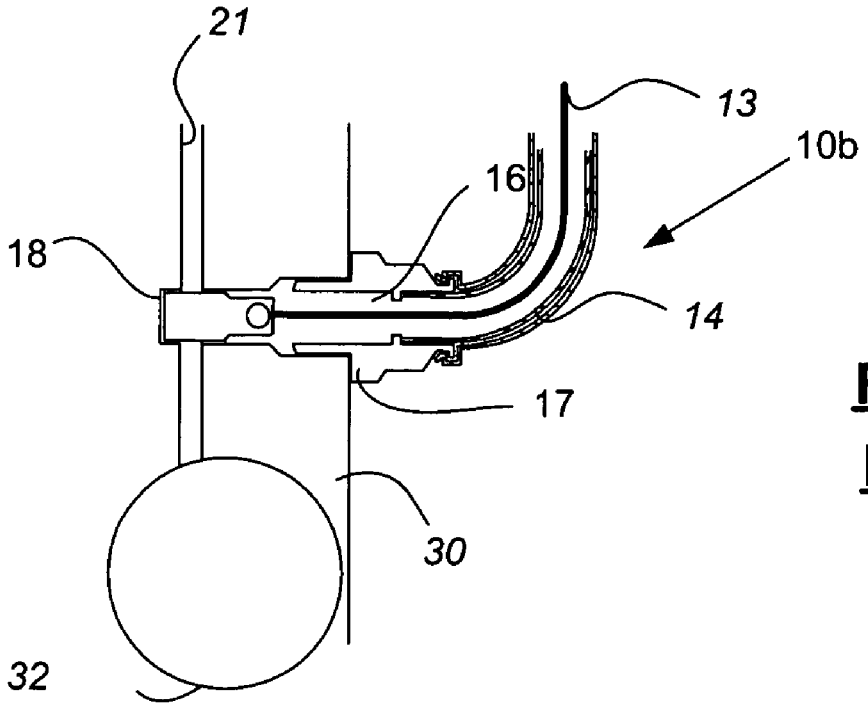
Figure 2a Prior Art
FIG. 2*a* is a side view of a prior-art engine assembly with a cable operated plunger valve installed.
Figure 2B:
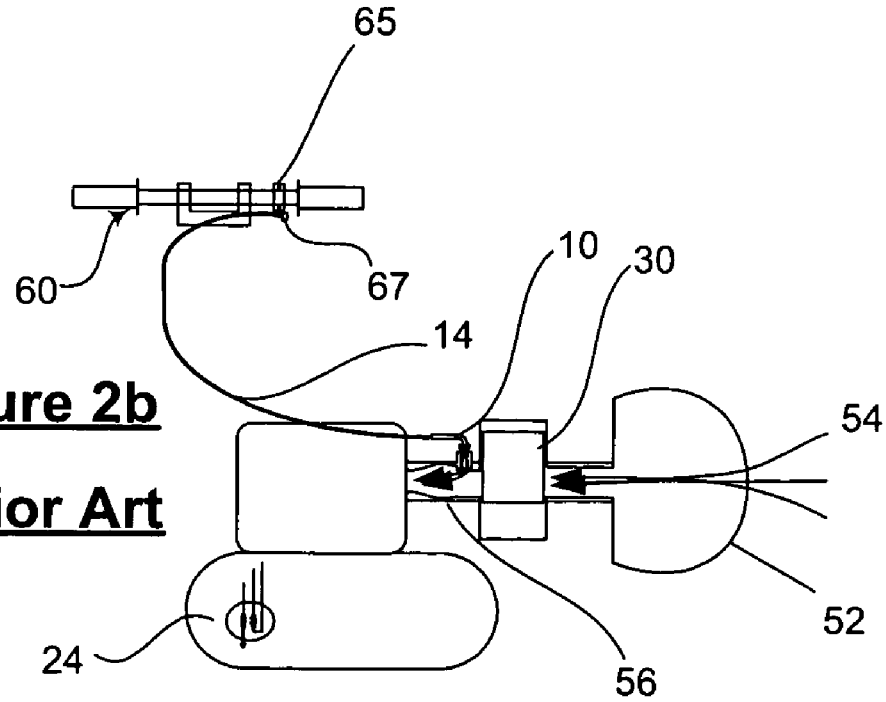
Figure 2b Prior Art
FIG. 2*b* is a system schematic of the prior-art engine assembly with a manual cable-controlled plunger valve installed.

Referring to FIGS. 2*a* and 2*b*, as with the manual system portrayed in FIGS. 1*a* and 1*b*, the plunger valve assembly 10 is incorporated onto a motorcycle internal combustion engine assembly 50 by installation into the carburetor throat 56. The cable system allows remote activation of the plunger valve assembly 10 and no longer requires the rider to remove hand from handlebars to manipulate the plunger handle 12 (FIG. 1*a*) during hot-start conditions. Cable systems allow remote location of the activation lever 65 near the rider's hand on the handlebars 60, but do require incorporation into the clutch or brake mounting hardware. A cable 13 and housing assembly 14 replaces the lever 12 and connects to the plunger valve assembly 10 on a first end and to the activation handle 67, fastened by a clamp 65 mounted on a handlebar. The use of the cable 13 and housing 14 requires lever 12 free play adjustment and associated cable 13 and housing 14 maintenance.

Also shown is the air filter 52 in the airflow 54 into the engine 50. The carburetor body is portrayed as is a stator 24 on an engine shaft.

Figure 3A:
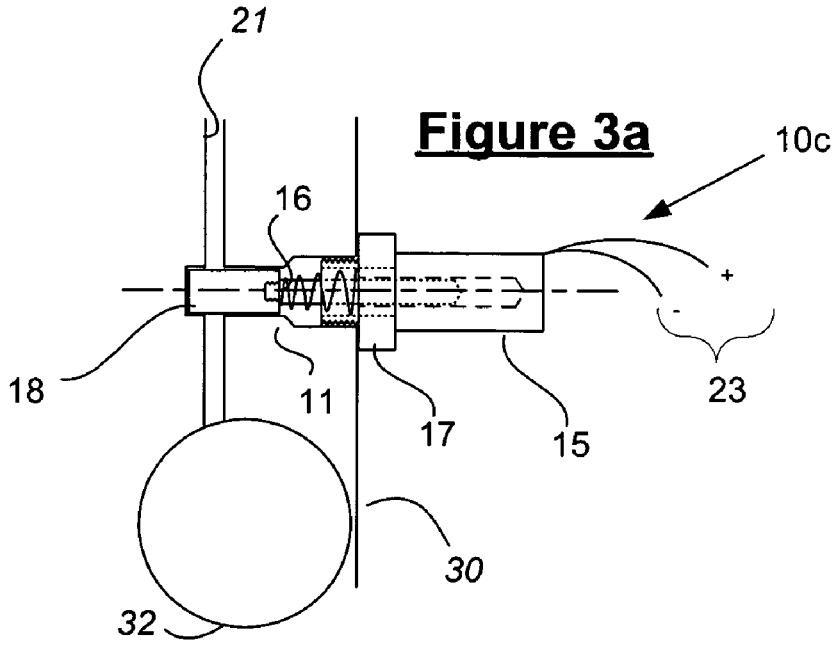
FIG. 3*a* is a side view of an engine assembly with a solenoid-controlled plunger valve installed.
Figure 3B:
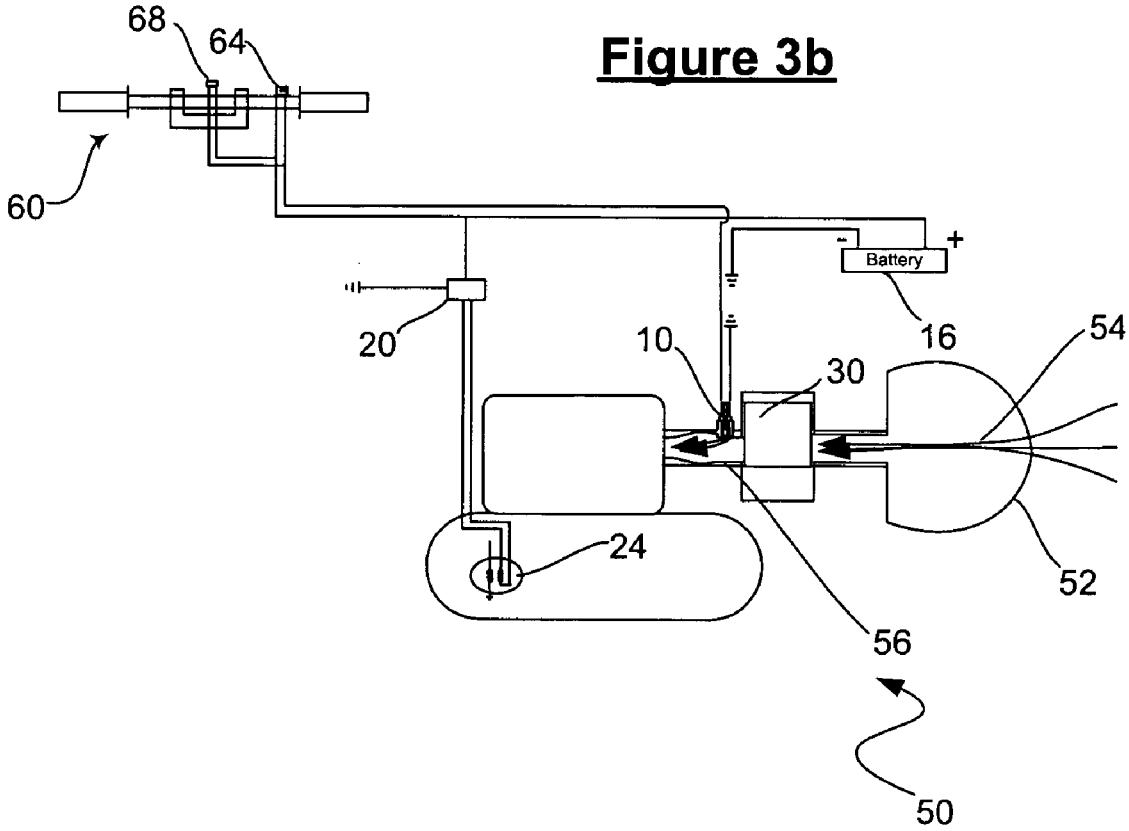
FIG. 3*b* is a system schematic of the engine assembly with a solenoid-controlled plunger valve installed.

Differing from the system portrayed in FIGS. 1*a* and 1*b* and the system portrayed in FIGS. 2*a* and 2*b*, the plunger valve assembly 10*c* of the present invention portrayed in FIGS. 3*a* and 3*b* is motivated by a solenoid 15 to allow electrical opening and closing of the needle valve 18.

In its simplest form, the invention is a solenoid actuator 15 for a hot start valve assembly 10*c*. Still present are the mounting nut 17, the valve needle 18 selectively admitting the atmospheric air 21 into the carburetor bore 32. A spring 10 optionally urges the valve needle 18 into a seat sealing the valve in opposition to the pull of the actuated solenoid 15. A pair of leads 23 selectively conducts a current to activate the solenoid 15.

Figure 4:
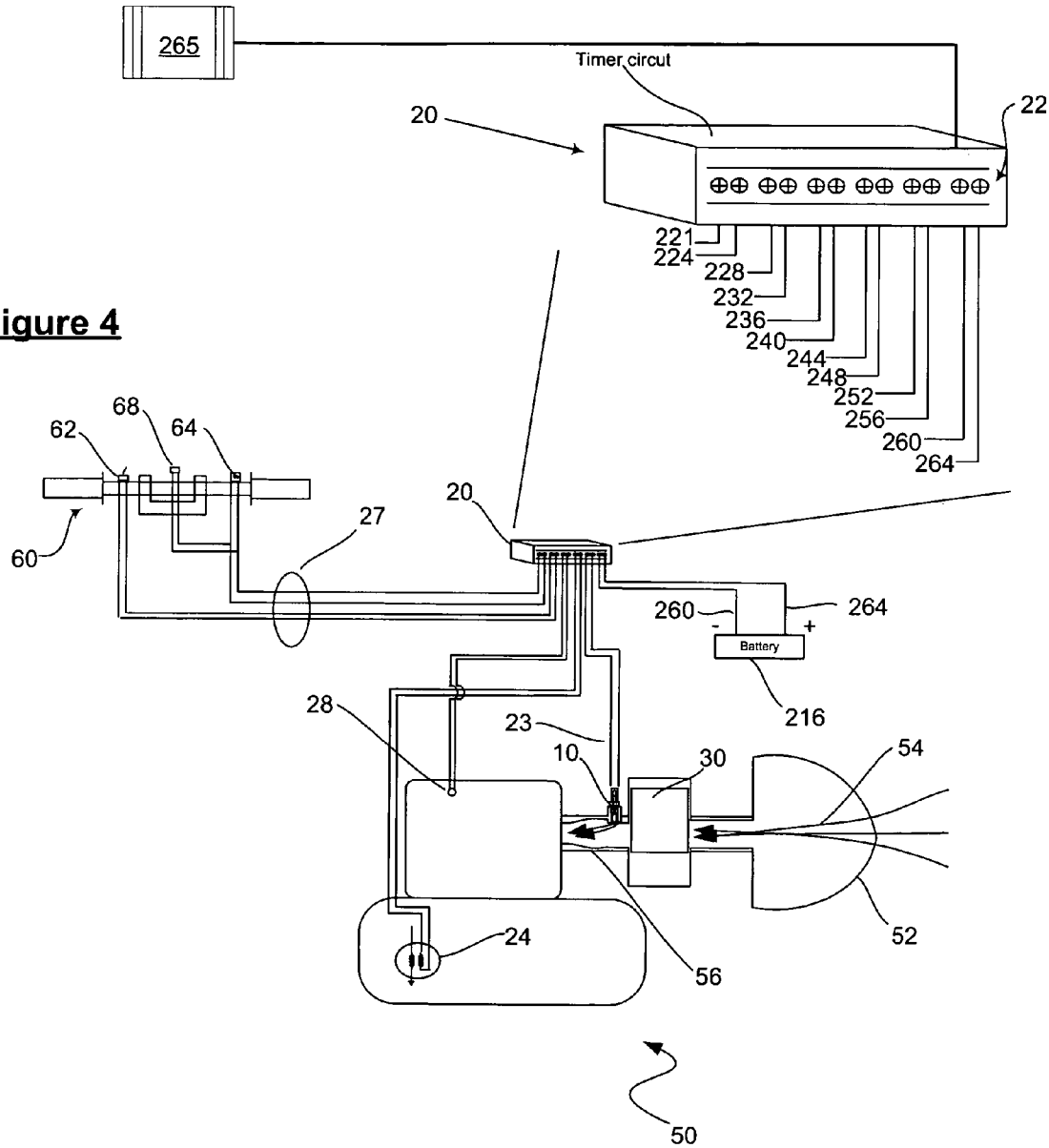
FIG. 4 is a system schematic of the engine assembly with a solenoid-controlled plunger valve installed.
Figure 5:
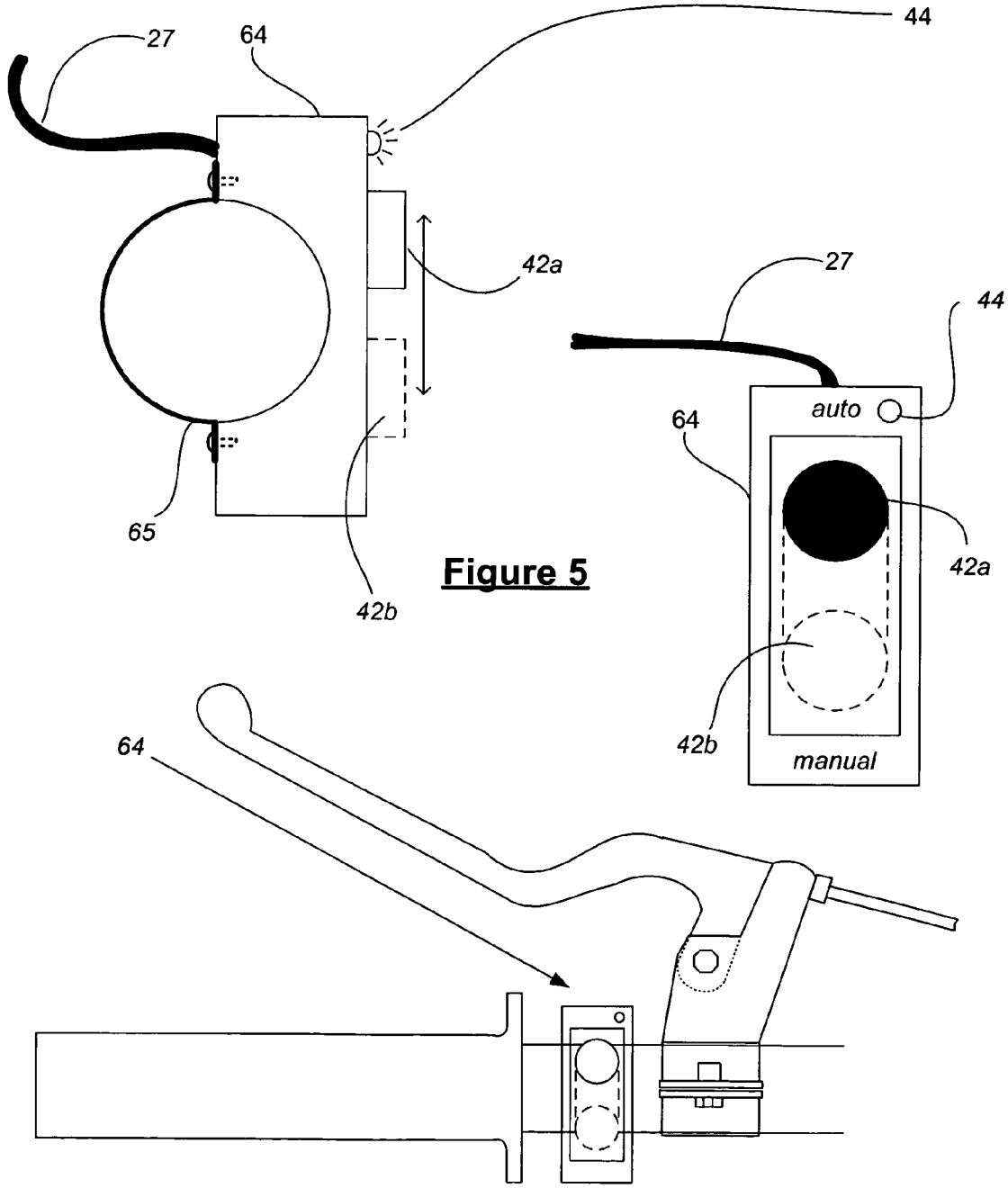
FIG. 5 is an alternate system schematic of the engine assembly with a solenoid-controlled plunger valve installed.

Principal elements of the solenoid plunger valve assembly 10 are shown in FIG. 4. The valve needle 18 is attached to a shaft 16 passing through a retaining nut 17. Rather than using a handle 12 (FIG. 1), a solenoid coil draws the shaft 16 which, in turn, draws the needle 18 away from the seat in the carburetor body (not shown). Wire connections 255 and 256 selectively energize the solenoid 15.

A presently preferred embodiment is shown in FIG. 4. A processor 20 is electrically interposed between the battery 216 and the plunger valve assembly 10 with wire connections 221 through 264. Specifically, the battery is connected by a positive wire connection 264 and a negative 260 or conventionally a ground wire connection. By two further wire connections 252 and 256, the processor 20 is connected to selectively operate the plunger valve assembly 10. The processor is also connected by two wire connections 244 and 248 to a stator 24 in magnetic proximity to an engine shaft for the purpose of indicating to the processor 20 the rotational state of the engine shaft thereby allowing the processor 20 to ascertain whether the engine is running. Still another pair of wire connections 236 and 240 connect a thermal sensor 28 to the processor 20 to indicate the temperature of the engine assembly 50.

Optionally a solar collector 265 is provided to charge the battery, ideally through a connection in the processor 20. In this embodiment, where a battery is used, charging the battery does not increase the load on the engine. The solar collector 265 is preferably a solar panel secured externally to the vehicle. A flexible panel may be used, for instance secured to the top of the fuel tank. A rigid panel may alternatively be used, mounted to the vehicle in an out-of-the-way location. Indeed, the solar panel might advantageously be placed on a helmet of a rider conducting a charging current through a suitable set of leads to the battery 216.

Another embodiment allows the substitution of a capacitor for the battery 216. Charging and discharging a capacitor to activate a solenoid 15 is advantageously used to form a no-maintenance package for such vehicles as may not require a more complex electrical system. In such a system, a current is generated by a rotor spinning with the engine shaft past the stator 24. Pressing a switch 64 activates the solenoid 15 by discharging the capacitor.

According to the presently preferred embodiment, the processor senses the temperature by means of the thermal sensor 28, whether the engine is running by virtue of the stator 24. Where the engine assembly 50 is suitably hot to require a hot-start strategy, when requested, the processor 20, admits current from the battery 216 to the valve assembly 10 admitting air to the carburetor body 56 as the starter (not pictured) turns the engine over.

The requesting mechanism in the presently preferred embodiment comprises the remaining four wire connections 221, 224, 228, and 232. Wire connections 221 and 224 connect to a switch 64 to request a hot-start activation of the plunger valve assembly.

An indicator light 68 shows the activation state of the switch 64. Both the indicator light 68 and the switch 64 are mounted on the handlebar 60 and communicate with the remainder of the system by means of a wire bundle 27. Activation of the switch 64 is received at the processor 20 as a request for hot-start activation of the plunger valve assembly 10. Additionally, a lock out switch 62, also mounted on the handlebar, allows the operator to lock out any request to activate the plunger valve assembly 10 where the operator's judgment suggests that overriding the processor 20 is appropriate.

Referring to FIGS. 5, 4, 3*a* and 3*b*, one embodiment of the invention includes a readily controllable interface between the rider and the invention. To further an object of the invention, the interface includes a switch 64 including a three-way activation system. The switch 64, in this embodiment, has a single push button normally open switch that the rider will depress to activate the solenoid 15. The single push button may also be moved from a position 42*a* to a position 42*b* to selectively enable an automatic feature of the invention. In the automatic mode, the timer circuits 20 will suitably and selectively activate the solenoid 15 to withdraw the valve needle 18 to allow hot starts. The position of the switch is conveyed by means of the wire bundle 27.

Advantageously, an LED 44 is included to indicate the interface state. Dual colored LEDs 44 might be used or a single colored LED 44. The purpose of the LED 44 is to allow the rider to be aware of the recognized state of the timer circuit. Such an LED 44 would advantageously serve as a troubleshooting enunciator for service of the system. In another embodiment, the LED 44 could signal the state of the valve rather than the state of the timer circuit. Another embodiment might include both LEDs.

Figure 6:
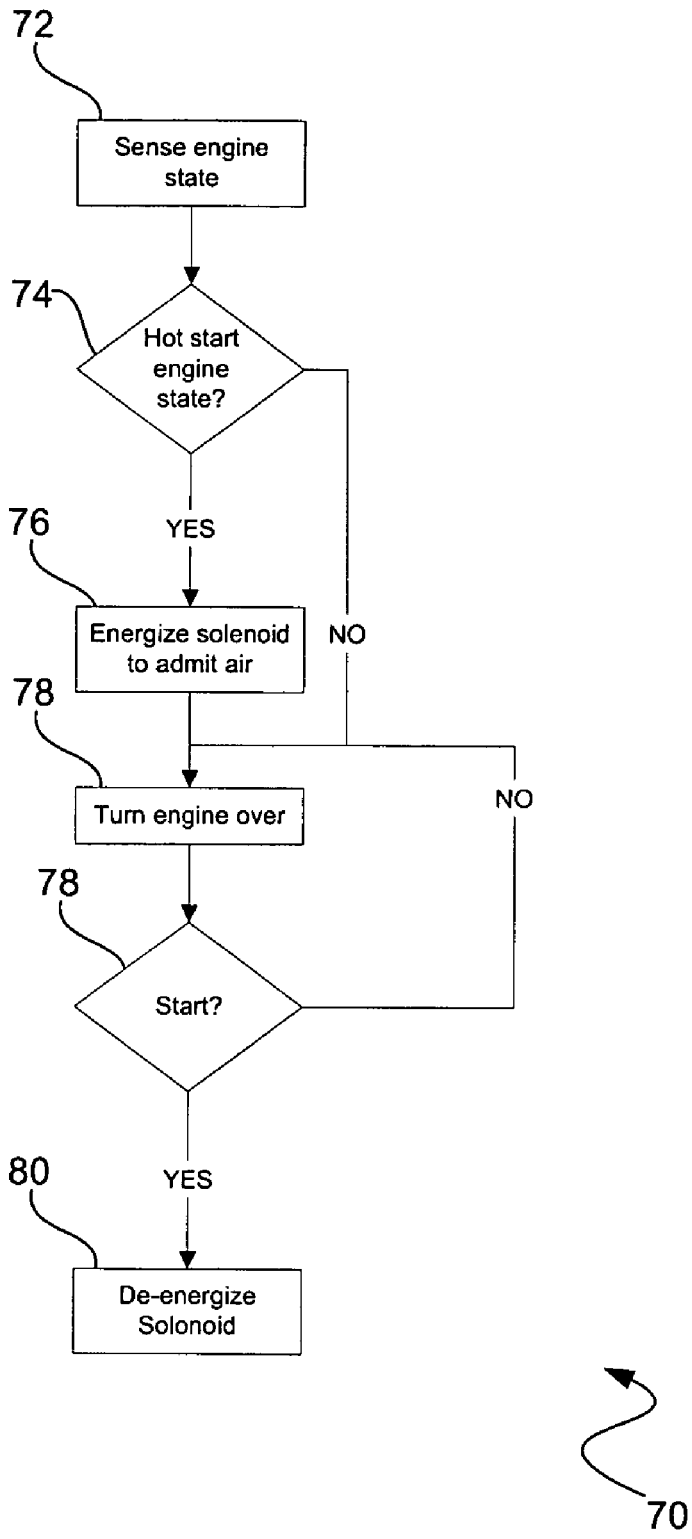
FIG. 6 is a flowchart of the method for a hot start of an engine using a solenoid-controlled plunger valve.

FIG. 6 is a flowchart of the method for a hot start of an engine using a solenoid-controlled plunger valve. The method begins with sensing the engine state to determine if it is running and its temperature. The process proceeds to element 74, a determination of the hot-start engine state. If the engine is in a hot-start, non-running engine state, the solenoid is energized to admit additional air into the carburetor. If it is not in a hot-start engine state then the solenoid is not activated and the engine is simply started without opening the valve with the solenoid. Under the hot-start state, once the solenoid is opened the engine is turned over. Once the engine is turned a check is made to see if the engine has started at which point the solenoid would be de-energized such that the valve is closed.

While the preferred embodiment of the invention has been illustrated and described, as noted above, many changes can be made without departing from the spirit and scope of the invention. For example, the system might further sense atmospheric pressure and compare it to manifold pressure for appropriate activation. Accordingly, the scope of the invention is not limited by the disclosure of the preferred embodiment.

The invention claimed is:

1. A hot-start mechanism for an internal combustion engine carburetor having an airflow passageway, the mechanism comprising:

a valve in fluid communication with the airflow passageway;

an engine-running sensor interconnected with said processor, said engine-running sensor providing a signal to said processor indicative of whether said engine is running;

an electrically-operated valve-movement mechanism operatively connected to said valve to selectively move said valve, activation of said valve-movement mechanism opening said valve when said engine-running sensor indicates that said engine is not running to admit additional air into the airflow passageway; and a valve switch electrically coupled to said valve-movement mechanism for activation of said valve.

2. The hot-start mechanism of claim 1, further comprising a processor electrically coupled to said switch for control of said valve and a power source electrically coupled to said processor.

3. The hot-start mechanism of claim 2, wherein said valve-movement mechanism comprises a solenoid, and wherein said valve comprises a plunger valve.

4. The hot-start mechanism of claim 3, further comprising a temperature sensor interconnected with said processor, said temperature sensor providing a signal indicative of the engine temperature, said processor only activating said solenoid to open said valve when the engine temperature is within a predetermined range.

5. The hot-start mechanism of claim 1, wherein said engine includes a stator, said engine-running sensor being interconnected to the stator to magnetically sense the dynamic rotational state of the engine.

6. The hot-start mechanism of claim 5, wherein said processor opens said valve upon predetermined input from said temperature sensor and said engine-running sensor.

7. The hot-start mechanism of claim 1, wherein said power source comprises a battery.

8. The hot-start mechanism of claim 1, wherein said power source comprises a capacitor.

9. The hot-start mechanism of claim 4, wherein said processor includes a timer switch for closing said valve after a predetermined time lapses with said valve open.

10. The hot-start mechanism of claim 4, wherein said processor opens said valve upon predetermined input from said temperature sensor.

11. The hot-start mechanism of claim 1, further comprising an indicator interconnected to the switch for signaling to a user of the engine whether said valve is open.

12. The hot-start mechanism of claim 2, further comprising an override switch interconnected to said valve-movement mechanism to control the position of said valve.

13. The hot-start mechanism of claim 2, wherein said processor includes a timer switch for closing said valve after a predetermined time lapses with said valve open.

14. The hot-start mechanism of claim 2, further comprising a temperature sensor interconnected with said processor, said temperature sensor providing a signal indicative of the engine temperature, said processor only activating said solenoid to open said valve when the engine temperature is within a predetermined range.

15. The hot-start mechanism of claim 14, wherein the engine includes a start switch and wherein said valve switch is coupled to said start switch for opening of said valve if the engine temperature is within a predetermined range and the start switch is activated.

16. The hot-start mechanism of claim 2, wherein said power source comprises a battery.

17. The hot-start mechanism of claim 16, further comprising a solar collector coupled to said battery.

18. The hot-start mechanism of claim 2, wherein the power source is a capacitor.

19. The hot-start mechanism of claim 2, further comprising an indicator interconnected to the switch for signaling to a user of the engine whether said valve is open.

20. The hot-start mechanism of claim 19, wherein said indicator comprises a light.

21. The hot-start mechanism of claim 1, wherein said valve-movement mechanism comprises a solenoid.

22. A method of starting a carbureted engine, comprising the steps of: sensing if the engine is currently running;

electrically opening an air-entrainment valve allowing additional air into the carburetor where the engine is sensed not to be running;

cranking the engine until a running state is achieved; and closing the valve.

23. The method of claim 22, wherein the valve is a plunger valve and wherein said step of opening the valve is carried out with a solenoid coupled to the plunger valve.

24. The method of claim 23, additionally comprising determining the need for additional air entrainment.

25. The method of claim 24 wherein determining the need for additional air entrapment comprises sensing the engine temperature.

26. The method of claim 22 wherein the running state is determined with an electrical connection to an engine stator.

27. The method of claim 22, wherein said step of closing the valve is accomplished with a time-out switch.

28. The method of claim 22, wherein said solenoid is powered with a battery.

29. The method of claim 28, wherein said battery is charged with a solar collector.

30. The method of claim 29, wherein said closing the valve is accomplished with a time-out switch.

31. The method of claim 24, wherein said step of determining the need for additional air entrainment comprises sensing the engine temperature.

32. The method of claim 24, wherein said step of determining the need for additional air entrainment comprises sensing the running state of the engine.

33. The method of claim 22, wherein said step of closing the valve is accomplished with a time-out switch.

34. The method of claim 22, wherein a vehicle start switch is used to switch open the air-entrainment valve after the step of determining of need for additional air entrainment.

35. The method of claim 22, wherein a vehicle start switch is used to switch open the air-entrainment valve after the step of determining of need for additional air entrainment.

36. An air-entrainment mechanism for a carbureted engine, comprising:

a sensor for sensing if the engine is running;

a plunger valve interconnected to the carburetor;

a solenoid coupled to said valve for opening said valve when the engine is sensed not to be running;

a battery electrically connected to said solenoid, said battery powering the movement of said solenoid; and a switch electrically coupled to said solenoid to activate said solenoid for movement of said valve.

37. The air-entrainment mechanism of claim 36, wherein said switch further comprising a temperature sensor, said switch being closable when said temperature sensor detects an engine temperature within a predetermined range.

* * * * *